US005211248A

United States Patent [19]

Nosewicz et al.

[11] Patent Number: 5,211,248

[45] Date of Patent: May 18, 1993

[54] PORTABLE SOIL SAMPLING DEVICE AND METHOD

[76] Inventors: Michael A. Nosewicz, P.O. Box 2664, Antioch, Calif. 94531; Stephen B. Turner, 1777 Nantucket Ct., Fairfield, Calif. 94533

[21] Appl. No.: 708,174

[22] Filed: May 31, 1991

[51] Int. Cl.[5] ..... E21B 1/02; E21B 25/00

[52] U.S. Cl. ..... 175/20; 73/864.45; 173/28; 175/58; 175/122; 175/135; 175/162; 175/203

[58] Field of Search ..... 175/20, 58, 135, 122, 175/162, 203, 220; 173/28; 73/864.43, 864.44, 864.45, 84; 166/79; 52/116, 117, 120; 254/386, 385

[56] References Cited

U.S. PATENT DOCUMENTS

| | | | |
|---|---|---|---|
| 607,577 | 7/1898 | Tipton | 173/84 X |
| 1,973,197 | 9/1934 | Baker | 254/386 X |
| 2,857,993 | 10/1958 | Terrell | 52/120 |
| 2,919,899 | 1/1960 | Hiteheoek | 175/220 X |
| 2,957,678 | 10/1960 | Jones | 254/139.1 |
| 3,015,374 | 1/1962 | Carbert et al. | 52/120 X |
| 3,367,188 | 2/1968 | Robinson | 73/452.2 |
| 4,081,040 | 3/1978 | Henson | 175/58 |
| 4,284,150 | 8/1981 | Davis | 175/84 |
| 4,333,541 | 6/1982 | Doty | 175/162 |
| 4,336,849 | 6/1982 | Hug | 175/58 X |
| 4,671,365 | 6/1987 | Bach et al. | 173/28 |
| 4,703,811 | 11/1987 | Lam | 173/28 |
| 4,770,030 | 9/1988 | Smith | 73/864.45 X |
| 5,004,055 | 4/1991 | Porritt et al. | 175/20 |

FOREIGN PATENT DOCUMENTS

| | | | |
|---|---|---|---|
| 1187554 | 2/1965 | Fed. Rep. of Germany | 175/220 |
| 645050 | 1/1979 | U.S.S.R. | 73/864.45 |
| 866110 | 9/1981 | U.S.S.R. | 52/116 |

*Primary Examiner*—Hoang C. Dang

*Attorney, Agent, or Firm*—Majestic, Parsons, Siebert & Hsue

[57] ABSTRACT

A portable soil sampling device is provided that is easily positoned in confined and hard-to-reach locations. The device includes a mast assembly comprising a pair of upright masts mounted on a frame having a pair of wheels. By tilting the frame and mast assembly back using a provided handle, the device may be transported to a sampling location. Where low overhead locations are encountered, such as within buildings, the mast assembly may be lowered with the use of a hinged connection intermediate its ends. The device is powered by hydraulic power from a remote source through flexible hydraulic hose, so as to help reduce the size and weight of the device. A hydraulic motor on the device is used to position a hydraulic hammer over a tube for driving. A hydraulic cylinder on the device is used to pull the sample tube from the ground after it has been driven to the desired depth. The invention also involves the method steps in accomplishing the above operation.

11 Claims, 2 Drawing Sheets

PORTABLE SOIL SAMPLING DEVICE AND METHOD

BACKGROUND OF THE INVENTION

This invention relates to a portable soil sampling device which is highly portable and may be positioned and used in confined spaces or hard-to-reach locations by as few as a single operator, together with a method therefor.

Many soil sampling devices are known in the prior art, which devices tend to be rather large and cumbersome. Typically, these devices are mounted on a large truck or other vehicle, such as a tractor. Examples of two truck-mounted soil sampling devices are shown in U.S. Pat. No. 4,284,150 to Davis, and U.S. Pat. No. 4,333,541 to Doty. While the latter soil sampling device is described as being mounted on a small pick-up type truck, such cannot be conveniently driven to steep, hilly locations for conducting soil sampling for building foundation work. Similarly, access for driving the truck may not be possible where other structures intervene, as when remodelling is taking place in the back yard of a house and there is no side yard access for the truck, even though there may be a walkway.

A much more difficult and, in fact, impossible location where truck-mounted soil sampling devices are concerned is within buildings. In situations involving toxic waste clean-up, soil samples are required, for example, under the ground floors of existing buildings. The only access to these sampling sites may be ordinary doors of conventional height and width for admitting egress and ingress of people. The maximum working height in these difficult locations may be only normal ceiling height.

While it may be possible to take a hand auger to this type of confined site, there are disadvantages with this approach. A major disadvantage is that a hand auger is not powerful enough. Other disadvantages are that a hand auger is labor-intensive, without achieving the desired penetration.

It is to a solution of these and other problems that this invention is directed.

SUMMARY OF THE INVENTION

The invention takes the form of a small, highly portable soil sampling device which may be positioned and operated by as few as a single person. The device makes use of hydraulic power, which is supplied from a remote source for actuation. Flexible hoses communicate the source of hydraulic power with the device. In this manner, the source of hydraulic power does not add to the size and weight of the soil sampling device.

The device itself comprises basically a tiltable upright mast assembly comprising a pair of masts mounted on a base or frame. Wheels rotatably mounted to the base permit the device to be manually wheeled to a sampling site. By tilting the mast assembly at a hinge connection intermediate its ends, the overall height of the device may be temporarily reduced to a height to permit passing through ordinary door openings. The device itself is narrower than ordinary door openings so that it may easily pass through to the sampling site.

A valve-actuated hydraulic motor on the frame having a drive pulley is used to raise a hydraulic driver. It does this by means of a cable passing over an idler pulley fixed to a horizontal cross member bridging the masts of the mast assembly at their top ends. A hook at the free end of the cable is disengaged and engaged with a hook eye in the top of a hydraulic hammer.

The hydraulic hammer is similarly raised by means of the hydraulic motor to a contacting position on the top of the sampling tube, with the tube end received within a bore in the bottom of the hammer housing. A valve is actuated to direct hydraulic fluid under pressure to the hammer and it drives the tube to a desired depth in the soil to be sampled. Thereafter, the motor is again actuated to remove the hammer from the tube end.

At this point, a washer-like plate ring is slipped over the free end of the tube and a second hook attached to a ring attached to one side of the plate ring. In this manner, the plate ring will be canted to grip the tube. A cable attached to the second hook passes over an idler pulley mounted on the rod end of a hydraulic cylinder. The other end of the cable is fixed to the frame. By actuating the hydraulic cylinder by means of a valve, the rod extends and causes the cable to tighten and then pull the tube and its contained soil sample out of the ground. Once the tube is free of the ground, the valve may be actuated to reverse the action of the hydraulic cylinder, and the tube is lowered gently to the ground for subsequent removal of the soil sample. After all sampling is complete, the mast assembly may be lowered and the device removed from the sampling site.

DETAILED DESCRIPTION

Figure 1:
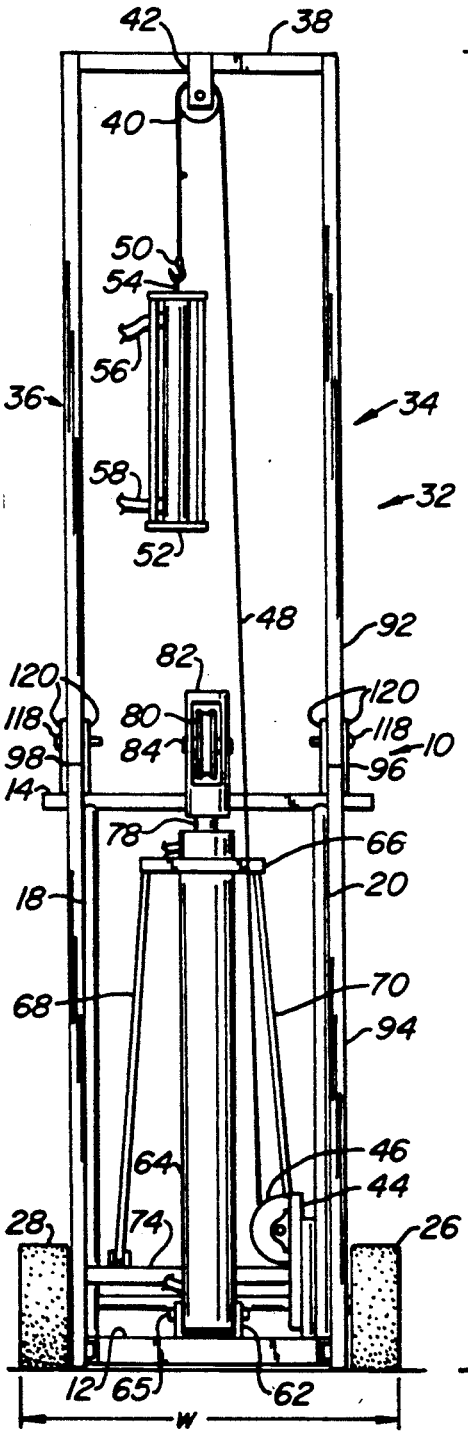
FIG. 1 is a front elevation view of the soil sampling device of the present invention with the mast assembly fully raised in the upright position.
Figure 2:
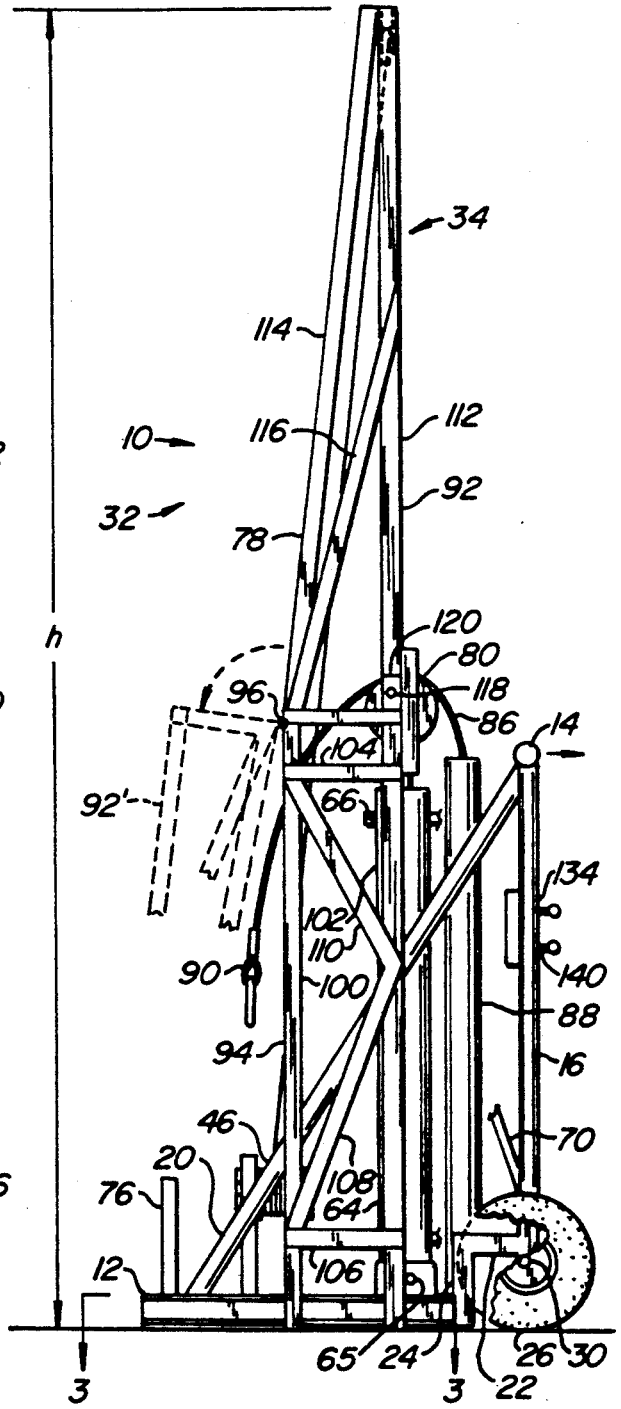
FIG. 2 is a side elevation view of the same showing in phantom line how the mast assembly can be tilted forward.

Turning to FIGS. 1 and 2 of the drawings, there is shown generally at 10 a soil sampling device of the instant invention. The device comprises a generally rectangular base or frame 12 which is planar so as to be adapted to sit on the ground support surface as shown in its operative condition. The base may be conveniently welded from steel angle material. For purposes of transporting the device, a horizontal tubular handle 14 is provided. The handle is supported by a pair of spaced, parallel tubular vertical support members, one of which is shown at 16. Also connected to the handle are a pair of spaced, angled support members which are angled to the horizontal plane of the frame 12. The frame, handle and support members may be of steel material welded together. Parenthetically, the entire device may be fabricated of steel material.

With particular reference to FIG. 2, the bottom end of each vertical support member is fixed to an end of a horizontal frame support member, one of which is shown at 22. The horizontal frame support member is, in turn, fixed at its other end to a vertical frame support member 24, which is of a length approximately the radius of wheels 26, 28 which are rotatably mounted on a transverse axle 30. Transverse axle 30 is mounted in alignment with vertical support member 16.

In this manner, an operator may pull the handle 14 in the arrow direction shown in FIG. 2, using the wheels 26, 28 as a pivot. The frame will be raised off the ground support surface and the device may be wheeled to a new location and tilted back into stable contact with the ground support surface.

An upright mast assembly 32 is also fixed, as by welding, to frame 12. The mast assembly comprises a pair of spaced parallel masts 34, 36 which are fixed to the frame 12. The vertical masts 34, 36 are joined together at their uppermost ends by a horizontal cross member 38. An idler pulley 40 is mounted between a pair of brackets, one of which is shown at 42, centrally disposed between masts 34, 36. The overall height "h" of the device is slightly less than that of the conventional ceiling, which is about 8 feet. The overall width "w" including wheels 26, 28 is less than conventional door width, which is about 30 inches. A width of about 28 inches allows sufficient clearance to enter a 30-inch wide door opening.

Mounted on frame 12 is a hydraulic motor 44 having a cable drum 46. A steel cable 48 is wound on drum 46 and has a free end passing over idler pulley 40 and ending in a first hook 50. A conventional hydraulic hammer 52 is suspended by means of a hook eye 54 at its topmost end. Parenthetically a conventional hydraulic hammer is sold under the trademark STANLEY under their Model No. PD 45. The hydraulic hammer is powered by hydraulic fluid through inlet and outlet conduits 58, 60, respectively, as will be more fully described hereafter.

Figure 3:
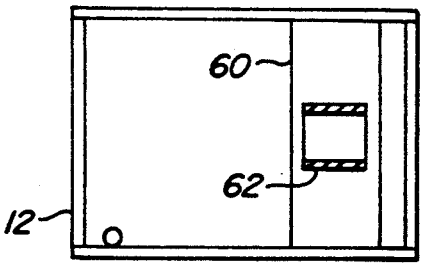
FIG. 3 is a view taken along lines 3—3 in FIG. 2.

As seen in FIG. 3, a cross member 60 is mounted within frame 12 so as to provide a support for yoke 62. Returning to FIG. 1, mounted on yoke 62 is a vertically oriented hydraulic cylinder 64. A bolt 65 passes through the yoke 62 and the bottom end of the hydraulic cylinder so as to secure the cylinder to the yoke and thereby to the frame. A collar 66 circumscribes the upper end of the cylinder 64, and holds cylinder 64 with the aid of a pair of stabilizing rods 68, 70. The stabilizing rods are fixed to the collar at their upper ends and to a cross member fixed intermediate the frame horizontal support members. A cylinder rod extends from the upper end of the cylinder.

A second idler pulley 80 is mounted within a yoke bracket 82 having a pivot 84 therethrough. A cable 86 has one end (not shown) fixed to frame 12. It then passes through a protective tube which is also fixed to the frame. The free end of cable 86 passes over idler pulley 80 and terminates in a hook 90. With reference to FIG. 2, a vertically-oriented mandrel is mounted on the frame 12 for temporary storage of a single sampling tube (not shown) which fits over the mandrel.

With reference to FIG. 2, the mast assembly structure and operation will now be described. Taking the left mast as exemplary, it has an upper subassembly 92 and a lower subassembly 94 pivotally connected together about mid-way between their ends by means of hinges 96, 98. The lower subassembly comprises a pair of vertical members joined together with a pair of horizontal members 104, 106 and a pair of angled stabilizing members 108, 110. Similarly, upper subassembly 92 comprises a vertical member 112 which is a straight line extension of vertical member 102 of the lower subassembly 94. It also comprises an angled generally vertical member 114 and an angled stabilizing member 116. The mast assemblies may be releasably locked together by convenient locking means 118, such as a bolt or pin passing through holes in a pair of plate brackets 120 affixed to the vertical members 102. It is to be understood that a locking means is present on each mast assembly.

Figure 5:
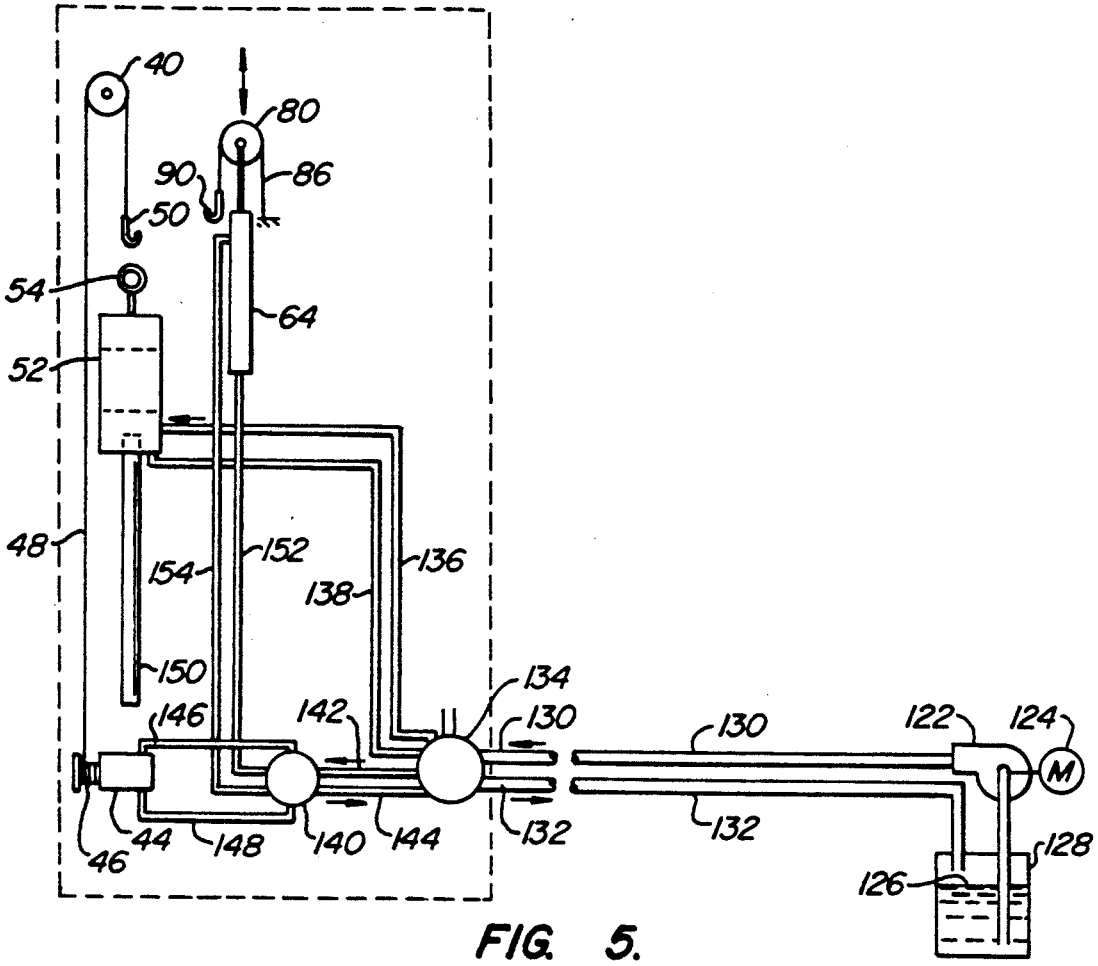
FIG. 5 is a schematic view of the hydraulic system of the invention.

The hydraulic system of the device will now be described by having reference to the schematic of FIG. 5. First of all, it should be noted that the device is represented as being within the dotted lines The source of fluid pressure is a hydraulic pump 122 which is driven by a motor 124. Fluid 126 is stored in a reservoir 128 Fluid under pressure is conveyed through the supply line 130 to the device and returned through a return line 132 to reservoir. The supply and return lines can be quite lengthy so that the soil sampling device may be located in difficult-to-access locations. The fluid pressure source might be conveniently located in a truck.

Fluid enters a first hydraulic valve 134 which is manually actuable from neutral to two positions. In one position, it directs fluid to and from hydraulic hammer 52 by means of conduits 136, 138, respectively. In a second position, valve 134 conducts fluid to and from a second valve 140 by means of conduits 142, 144, respectively. The second valve 140 is manually actuable from a neutral position to a first position directing fluid to and from hydraulic motor 44 for actuation thereof to raise and lower hook 50, and its load, which in this case is shown to be hydraulic hammer 52, has a bore therein positioned over sampling tube 150 for purposes of driving into the ground.

Figure 4:
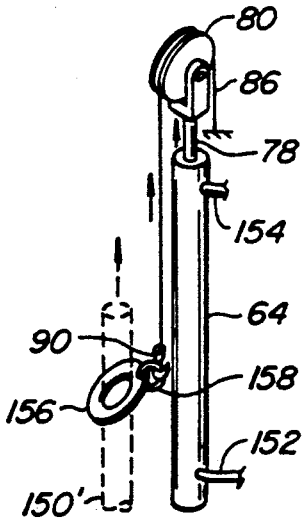
FIG. 4 is an isometric, partial elevation view illustrating the removal of the sampling tube by means of the hydraulic cylinder.

In a second position of the valve 140, fluid is directed from and to hydraulic cylinder 64 through conduits 152, 154. As best seen in FIG. 4, the function of cylinder 64 is to remove driven sampling tubes from the ground. A washer-like plate ring 156 having an internal aperture which is greater than the external diameter of a sampling tube 150' has a ring 158 mounted on one side and adapted to receive hook 90. By actuating the cylinder 64, hook 90 is raised by means of cable 86, which tilts plate ring 156 so as to grip the tube. In this manner, further actuation of the cylinder pulls the tube from the ground.

The method of operation is as follows First, the device is moved to a first sampling location. A hydraulic hammer is raised by means of a first hook, cable, and hydraulic motor to be mounted on the sampling tube to be driven. The hydraulic motor is actuated to drive the tube to the desired depth. The motor is again actuated to remove the hydraulic hammer from the tube end. A cable is connected to the tube by means of, e.g. a plate ring, and the hydraulic cylinder actuated to remove the tube from the ground. The tube is then lowered to the ground and the core sample removed for study. The device may then be moved to a new location for further sampling, and so on. As an intermediate step, the mast assembly may be lowered and then raised where low overhead locations are encountered. As an alternative preliminary step, the sampling tube may be raised into driving position by means of the first hook, cable, and hydraulic motor.

Although a preferred embodiment of the invention has been described, it is to be understood that various modifications and alterations may be made within the full scope of the invention, as defined by the appended claims.

What is claimed is:

1. A portable soil sampling device comprising:

(a) a generally horizontal frame adapted for contacting a support surface;

(b) a generally vertical mast assembly defining a height above said support surface mounted on said frame;

(c) hydraulic removal means on said device for removing sample tubes after they have been driven to a desired depth;

(d) a source of hydraulic fluid under pressure for powering said hydraulic removal means, said fluid pressure source being located remotely from said device;

(e) conduit means intercommunicating said fluid pressure source with said hydraulic removal means;

(f) hydraulic driving means on said device for driving sample tubes, said driving means comprising a hydraulic hammer adapted for contacting and driving a sample tube; and (g) a hydraulic motor drivingly connected to a cable drum, a cable around said drum, and wherein said cable has a free end connected to said hydraulic driving means, whereby said hydraulic motor may be actuated to raise and lower said hydraulic hammer into and out of operative position in contact with said sample tube.

2. The invention of claim 1 further including an idler pulley mounted on said mast assembly, and wherein said cable passes over said pulley.

3. The invention of claim 1 wherein said hydraulic removal means comprises a hydraulic cylinder including a cylinder rod, a pulley mounted on said cylinder rod, a second cable passing over said pulley, said second cable having one end fixed to said device and a free end having a hook means thereon adapted for connection to a sample tube.

4. The invention of claim 3 further including a washer-like plate member defining an aperture therein adapted to be passed over a sample tube end, said plate member also including means for connecting to said hook means of said hydraulic removal means.

5. The invention of claim 1 further including valve means on said device for selectively directing fluid from said fluid pressure source to said hydraulic removal means and said hydraulic driving means.

6. The invention of claim 1 further including means on said mast assembly whereby the overall height of said mast assembly may be temporarily reduced to facilitate transport of said device to low overhead locations.

7. The invention of claim 1 further including wheels rotatably mounted on said device for transport thereof, and means whereby said wheels are inoperable until said device is tilted back at an angle.

8. A method of soil sampling using sample tubes by means of a portable device having a generally vertical mast assembly mounted on a generally horizontal frame comprising the steps of:

(a) moving a hydraulic hammer to a contacting position on a vertically oriented sample tube by directing fluid to a hydraulic motor so as to actuate a drum having a cable and hook means attached thereto, and wherein said hook means is attached to said hydraulic hammer;

(b) directing hydraulic fluid to said hydraulic hammer to drive the sample tube to the desired depth;

(c) removing the hydraulic hammer from the sample tube;

(d) connecting the sample tube to a hydraulic removal means on said device;

(e) directing hydraulic fluid to said hydraulic removal means so as to remove said sample tube including its sample.

9. The method of claim 8 further including the step of directing fluid to said hydraulic removal means so as to lower the filled sample tube to the support surface for removal of its sample.

10. The method of claim 8 further including the preliminary step of lowering said mast assembly so as to facilitate entry into low overhead locations.

11. The method of claim 8 further including the preliminary step of tilting said device back at an angle to the support surface so that wheels thereon become operative for moving.

* * * * *